US009504293B2

(12) United States Patent
Tsang

(10) Patent No.: US 9,504,293 B2
(45) Date of Patent: Nov. 29, 2016

(54) OUTSOLE WITH EXTENDABLE TRACTION ELEMENTS

(75) Inventor: Patty W. Tsang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 741 days.

(21) Appl. No.: 13/089,124

(22) Filed: Apr. 18, 2011

(65) Prior Publication Data

US 2012/0260535 A1 Oct. 18, 2012

(51) Int. Cl.

| | |
|---|---|
| ***A43B 5/00*** | (2006.01) |
| ***A43B 13/00*** | (2006.01) |
| ***A43B 23/28*** | (2006.01) |
| ***A43C 15/00*** | (2006.01) |
| ***A43B 13/26*** | (2006.01) |
| ***A43B 13/22*** | (2006.01) |
| ***A43B 13/18*** | (2006.01) |
| ***A43C 15/14*** | (2006.01) |

(52) U.S. Cl.

CPC ..... *A43B 13/26* (2013.01); *A43B 13/184* (2013.01); *A43B 13/22* (2013.01); *A43B 13/223* (2013.01); *A43C 15/14* (2013.01)

(58) Field of Classification Search

CPC .... A43B 13/223; A43B 13/26; A43B 13/12; A43B 13/14; A43B 13/184; A43B 13/145; A43B 13/22; A43B 13/24; A43B 13/146; A43B 13/122; A43B 13/125; A43B 13/226; A43B 5/001; A43C 15/14; A43C 15/16; A43C 15/161; A43C 15/162; A43C 15/164; A43C 15/165; A43C 15/167

USPC ..... 36/3 B, 3 R, 15, 25 R, 28, 30 R, 32 R, 36/59 A, 59 R, 61, 67 A, 67 C, 103, 134

See application file for complete search history.

(56) References Cited

U.S. PATENT DOCUMENTS

| | | | | |
|---|---|---|---|---|
| 303,287 | A | 8/1884 | Nunn | |
| 628,209 | A * | 7/1899 | O'Sullivan | A43C 15/161 248/363 |
| 830,324 | A | 9/1906 | Hunt | |
| 869,764 | A * | 10/1907 | Anderson | 36/59 R |
| 1,361,078 | A | 12/1920 | Lynn | |
| 1,559,450 | A | 10/1925 | Oakley | |
| 2,087,945 | A | 7/1937 | Butler | |
| 2,095,095 | A | 10/1937 | Howard | |

(Continued)

FOREIGN PATENT DOCUMENTS

| | | |
|---|---|---|
| CA | 2526727 | 5/2007 |
| CN | 101116261 A | 1/2008 |

(Continued)

OTHER PUBLICATIONS

Partial Search Report for PCT/US20091058522 dated Mar. 4, 2010.

(Continued)

*Primary Examiner* — Anna Kinsaul
*Assistant Examiner* — Jameson Collier
(74) *Attorney, Agent, or Firm* — Banner & Witcoff, Ltd.

(57) ABSTRACT

An outsole element may include a first side configured for attachment to a midsole or other shoe component and an exposed second side opposite the first side. A plurality of recesses can be formed in the second side. Each of those recesses may include a concave region aligned with a corresponding raised region located on the first side and may further include a corresponding traction element.

20 Claims, 7 Drawing Sheets

(56) References Cited

U.S. PATENT DOCUMENTS

| | | | | |
|---|---|---|---|---|
| 2,222,650 | A | 11/1940 | Brady | |
| 2,258,734 | A | 10/1941 | Brady | |
| 2,853,809 | A * | 9/1958 | Bianchi | 36/59 C |
| 3,043,026 | A | 7/1962 | Semon | |
| 3,619,916 | A | 11/1971 | Neri | |
| 3,631,614 | A | 1/1972 | Rice | |
| 3,775,874 | A | 12/1973 | Bonneville | |
| 3,951,407 | A | 4/1976 | Calacurcio | |
| 4,146,979 | A | 4/1979 | Fabbrie | |
| 4,223,459 | A | 9/1980 | Riggs | |
| 4,271,608 | A | 6/1981 | Tomuro | |
| 4,375,728 | A | 3/1983 | Dassler | |
| 4,375,729 | A | 3/1983 | Buchanen, III | |
| 4,402,145 | A | 9/1983 | Dassler | |
| 4,466,205 | A | 8/1984 | Corbari | |
| 4,633,600 | A | 1/1987 | Dassler et al. | |
| 4,674,200 | A | 6/1987 | Sing | |
| 4,715,133 | A | 12/1987 | Hartjes et al. | |
| 4,821,434 | A * | 4/1989 | Chein | 36/134 |
| 4,825,562 | A * | 5/1989 | Chuang | 36/61 |
| 4,833,796 | A | 5/1989 | Flemming | |
| 4,873,774 | A | 10/1989 | Lafever | |
| 5,221,379 | A | 6/1993 | Nicholas | |
| 5,224,279 | A * | 7/1993 | Agnew | 36/30 R |
| 5,289,647 | A | 3/1994 | Mercer | |
| 5,299,369 | A | 4/1994 | Goldman | |
| 5,324,369 | A * | 6/1994 | Yamada | 152/211 |
| 5,351,422 | A | 10/1994 | Fitzgerald | |
| 5,362,435 | A * | 11/1994 | Volpe | B29B 11/04 12/146 B |
| 5,367,791 | A | 11/1994 | Gross et al. | |
| 5,513,451 | A | 5/1996 | Kataoka et al. | |
| 5,526,589 | A | 6/1996 | Jordan | |
| 5,634,283 | A | 6/1997 | Kastner | |
| 5,761,832 | A | 6/1998 | George | |
| 5,768,802 | A * | 6/1998 | Bramani | 36/28 |
| 5,775,010 | A | 7/1998 | Kaneko | |
| 5,815,951 | A | 10/1998 | Jordan | |
| 5,870,838 | A | 2/1999 | Khayat | |
| 5,946,828 | A | 9/1999 | Jordan et al. | |
| 5,956,871 | A | 9/1999 | Korsen | |
| 5,979,083 | A | 11/1999 | Robinson et al. | |
| 6,029,377 | A | 2/2000 | Niikura et al. | |
| 6,076,283 | A | 6/2000 | Boie | |
| 6,079,127 | A | 6/2000 | Nishimura et al. | |
| 6,112,433 | A | 9/2000 | Greiner | |
| 6,125,556 | A | 10/2000 | Peckler et al. | |
| 6,256,907 | B1 | 7/2001 | Jordan et al. | |
| 6,389,714 | B1 | 5/2002 | Mack | |
| 6,481,122 | B2 | 11/2002 | Brahler | |
| 6,550,160 | B2 | 4/2003 | Miller, II | |
| 6,647,647 | B2 | 11/2003 | Auger et al. | |
| 6,675,505 | B2 | 1/2004 | Terashima | |
| 6,698,110 | B1 | 3/2004 | Robbins | |
| 6,739,075 | B2 | 5/2004 | Sizemore | |
| D495,122 | S | 8/2004 | McMullin | |
| 6,904,707 | B2 | 6/2005 | McMullin | |
| 6,915,595 | B2 | 7/2005 | Kastner | |
| 6,915,596 | B2 | 7/2005 | Grove et al. | |
| 6,941,684 | B2 | 9/2005 | Auger et al. | |
| 7,007,410 | B2 | 3/2006 | Auger et al. | |
| 7,143,530 | B2 | 12/2006 | Hudson et al. | |
| 7,194,826 | B2 | 3/2007 | Ungari | |
| 7,200,955 | B2 * | 4/2007 | Foxen | A43B 7/1425 36/25 R |
| 7,204,044 | B2 | 4/2007 | Hoffer et al. | |
| 7,234,250 | B2 | 6/2007 | Fogarty et al. | |
| 7,254,909 | B2 | 8/2007 | Ungari | |
| 7,269,916 | B2 | 9/2007 | Biancucci et al. | |
| 7,287,343 | B2 | 10/2007 | Healy | |
| 7,370,439 | B1 | 5/2008 | Myers | |
| 7,386,948 | B2 | 6/2008 | Sink | |
| 7,406,781 | B2 | 8/2008 | Scholz | |
| 7,409,783 | B2 | 8/2008 | Chang | |
| 7,430,819 | B2 | 10/2008 | Auger et al. | |
| 7,490,418 | B2 | 2/2009 | Obeydani | |
| 7,584,554 | B2 | 9/2009 | Fogarty et al. | |
| 7,784,196 | B1 | 8/2010 | Christensen et al. | |
| 2002/0017036 | A1 | 2/2002 | Berger et al. | |
| 2003/0033731 | A1 | 2/2003 | Sizemore | |
| 2004/0035024 | A1 | 2/2004 | Kao | |
| 2004/0163282 | A1 * | 8/2004 | Pan | 36/59 R |
| 2004/0187356 | A1 | 9/2004 | Patton | |
| 2004/0250451 | A1 | 12/2004 | McMullin | |
| 2005/0072026 | A1 | 4/2005 | Sink | |
| 2005/0217149 | A1 | 10/2005 | Ho | |
| 2005/0257405 | A1 | 11/2005 | Kilgore | |
| 2005/0268490 | A1 | 12/2005 | Foxen | |
| 2006/0016101 | A1 | 1/2006 | Ungari | |
| 2006/0021254 | A1 | 2/2006 | Jones | |
| 2006/0130372 | A1 | 6/2006 | Auger et al. | |
| 2007/0261271 | A1 | 11/2007 | Krouse | |
| 2008/0066348 | A1 | 3/2008 | O'Brien et al. | |
| 2008/0196276 | A1 | 8/2008 | McMullin | |
| 2008/0216352 | A1 | 9/2008 | Baucom et al. | |
| 2008/0271341 | A1 * | 11/2008 | Amark | 36/61 |
| 2009/0056172 | A1 | 3/2009 | Cho | |
| 2009/0100716 | A1 | 4/2009 | Gerber | |
| 2009/0100718 | A1 | 4/2009 | Gerber | |
| 2009/0126230 | A1 | 5/2009 | McDonald et al. | |
| 2009/0241370 | A1 | 10/2009 | Kimura | |
| 2009/0307933 | A1 | 12/2009 | Leach | |
| 2010/0024250 | A1 * | 2/2010 | Fogarty et al. | 36/100 |
| 2010/0077635 | A1 | 4/2010 | Baucom et al. | |
| 2010/0083541 | A1 | 4/2010 | Baucom et al. | |
| 2010/0251578 | A1 | 10/2010 | Auger et al. | |
| 2011/0047830 | A1 | 3/2011 | Francello et al. | |
| 2011/0078927 | A1 | 4/2011 | Baker | |
| 2011/0126426 | A1 | 6/2011 | Amark | |
| 2011/0197478 | A1 | 8/2011 | Baker | |
| 2011/0203136 | A1 | 8/2011 | Auger | |
| 2012/0036740 | A1 * | 2/2012 | Gerber | 36/134 |

FOREIGN PATENT DOCUMENTS

| | | | |
|---|---|---|---|
| CN | 101951799A | A | 1/2011 |
| DE | 930798 | | 7/1955 |
| DE | 3046811 | | 7/1982 |
| DE | 3245182 | | 5/1983 |
| DE | 3600525 | | 10/1987 |
| DE | 3644812 | C1 | 6/1988 |
| EP | 0223700 | | 5/1987 |
| EP | 1714571 | | 10/2006 |
| EP | 1839511 | | 10/2007 |
| EP | 2057913 | | 5/2009 |
| FR | 2567004 | | 1/1986 |
| FR | 2818876 | | 7/2002 |
| JP | S53-111464 | | 2/1980 |
| JP | 62-26001 | | 2/1987 |
| JP | 6-217802 | | 8/1994 |
| JP | 10-108706 | | 4/1998 |
| JP | 100000105 | | 6/1998 |
| JP | 3106804 | U | 11/2004 |
| JP | 2008212532 | A | 9/2008 |
| TW | 540323 | U | 7/2003 |
| TW | M267886 | U | 6/2005 |
| WO | 0053047 | | 9/2000 |
| WO | 3071893 | | 9/2003 |
| WO | 2006086280 | A | 8/2006 |
| WO | 2006103619 | | 10/2006 |
| WO | 2008069751 | | 6/2008 |
| WO | 2008128712 | | 10/2008 |
| WO | 2009110822 | | 9/2009 |
| WO | 2010036988 | | 4/2010 |
| WO | 2010057207 | | 5/2010 |

OTHER PUBLICATIONS

International Search Report and Written Opinion of PCT/US2010/029640 dated May 17, 2010.

U.S. Appl. No. 12/239,190, filed Sep. 26, 2008.

(56) References Cited

OTHER PUBLICATIONS

U.S. Appl. No. 12/566,792 filed Sep. 25, 2009.
U.S. Appl. No. 12/711,107, filed Feb. 23, 2010.
U.S. Appl. No. 12/708,411, filed Feb. 18, 2010.
U.S. Appl. No. 12/572,154, filed Oct. 1, 2009.
International Search Report and Written Opinion of PCT/US2009/058522 dated Feb. 17, 2010.
U.S. Appl. No. 12/752,318, filed Apr. 1, 2010.
International Search Report and Written Opinion for PCT/US2010/050637 dated Jan. 14, 2011.
International Search Report and Written Opinion for PCT/US2011/022841 dated Apr. 15, 2011.
International Search Report and Written Opinion for PCT/US2011/022848 dated Jun. 20, 2011.
Aug. 12, 2010, Icebug web page (date based on information from Internet Archive).
Dec. 23, 2008, Icebug web page (date based on information from Internet Archive).
International Search Report and Written Opinion for PCT/US2011/045356 dated Dec. 16, 2011.

* cited by examiner

OUTSOLE WITH EXTENDABLE TRACTION ELEMENTS

BACKGROUND

"Traction" is a general term that describes the ability of a shoe outsole to resist sliding motion over a surface contacted by that outsole. Traction is particularly important for footwear used in sports and other activities in which a shoe wearer wishes to move quickly and/or to rapidly change movement directions relative to a potentially slippery surface. For an athlete, secure, non-sliding contact between that athlete's footwear and a playing surface can be important for preventing injury and for improving the athlete's performance.

It is known to include cleats or other traction-enhancing outsole extensions on footwear intended for use in sports and/or other activities. During running or other actions, these extensions can penetrate a ground surface and help stabilize an athlete's foot from unwanted movement. Unfortunately, a single configuration for traction extensions an athletic shoe may not be optimal over a range of conditions in which that shoe will be used. For example, some surfaces can have extremely variable conditions. If a playing surface is softer and/or more slippery, a larger number of extensions can be useful. When the ground is harder or less slippery, however, fewer extensions may be needed. An athlete may also need more traction during some specific movements (e.g., while running) and less traction during other actions (e.g., while standing).

Although useful to increase traction, outsole extensions can also be sources of discomfort. In particular, a protruding traction element can generate a point pressure on a shoe wearer's foot. An outsole extension that might be useful under some conditions (e.g., when running) may be a source of irritation under other conditions (e.g., when standing). Finding the correct balance between traction enhancement and comfort for footwear thus remains an ongoing challenge.

SUMMARY

This Summary is provided to introduce a selection of concepts in a simplified form that are further described below in the Detailed Description. This Summary is not intended to identify key or essential features of the invention.

In at least some embodiments, an outsole element can include a first side and an exposed second side opposite the first side. The first side can be bonded or otherwise attached to a midsole or other shoe component when a shoe is assembled. The outsole element may further include a plurality of recesses formed in the second side. Each of those recesses may include a concave region that is aligned with a corresponding raised region on the first side. Each recess may further include a corresponding traction element extending outward from the interior of the concave region. In response to force induced by a wearer of a shoe including the outsole element, raised regions of the outsole element may be deformed and the traction elements extended.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
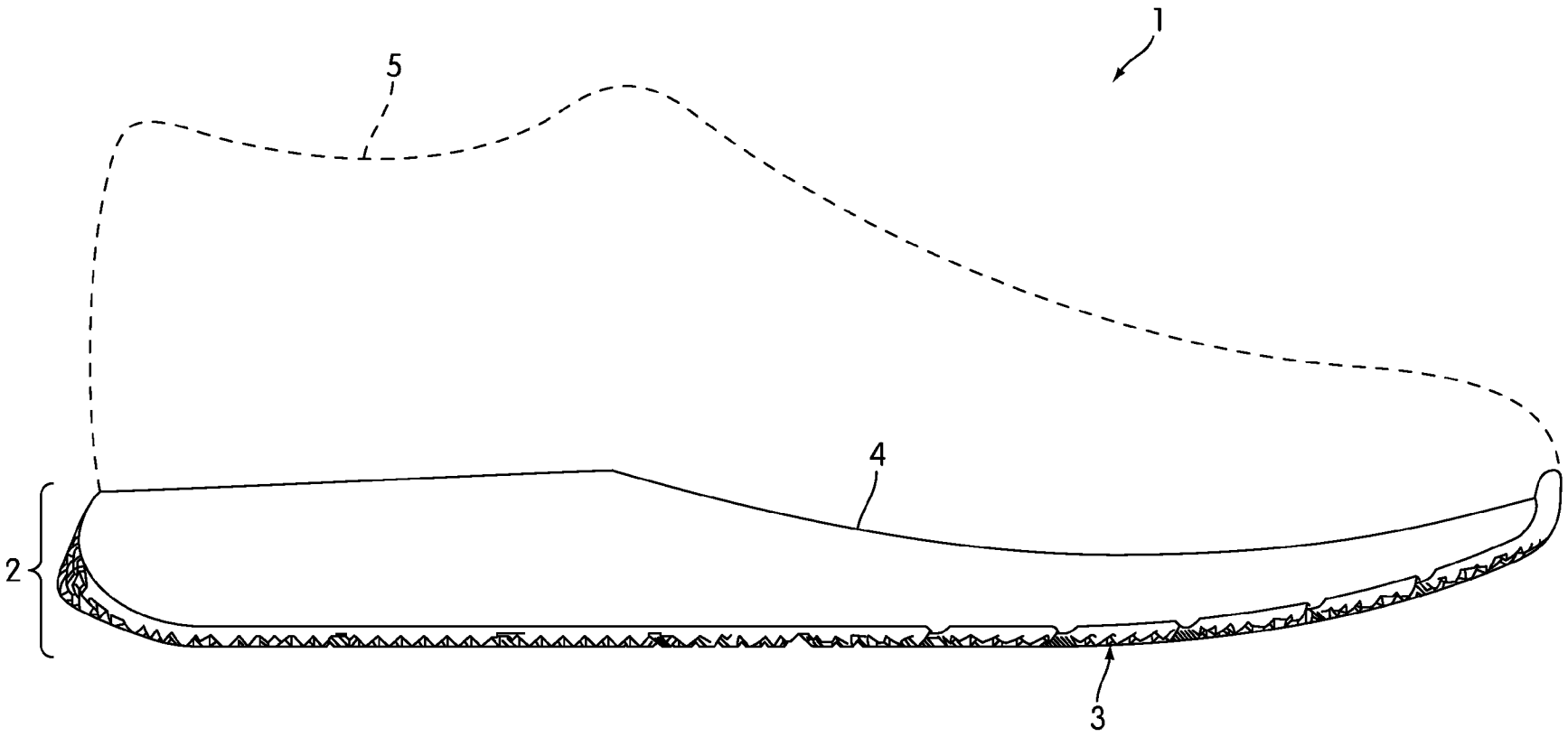
FIG. 1 is a lateral side view of an article of footwear according to some embodiments.

FIG. 1 is a lateral side view of a shoe 1 according to some embodiments. Shoe 1 can be a training shoe intended for wear during running and various other types of training activities. Embodiments also include footwear intended for use in other athletic and non-athletic activities. Shoe 1 is a right foot shoe from a pair of shoes. The left foot shoe of that pair is a mirror image of shoe 1.

Shoe 1 includes a sole structure 2. Sole structure 2 includes an outsole 3 and a midsole 4. These and other components of sole structure 2 are further described below. Although not shown in FIG. 1, sole structure 2 also includes a gas-filled cushioning pad in a heel region. Although various specific features of sole structure 2 are described herein, such description merely provides examples of features according to certain embodiments. Other embodiments may include less than all of the features shown in the drawings for shoe 1 and/or may include additional features. In other embodiments, for example, a sole structure may only include an outsole or might otherwise lack a separate midsole. In still other embodiments, sole structure 2 could include a support plate or other elements.

Shoe 1 also includes an upper 5. Upper 5 can be placed on a last and bonded to midsole 4 when shoe 1 is assembled. Shoes having sole structures according to various embodiments can include various types of uppers. Because the details of such uppers are not pertinent to understanding sole structures disclosed herein, upper 5 is shown generically in FIG. 1 using a broken line and is not discussed below in further detail.

Figure 2A:
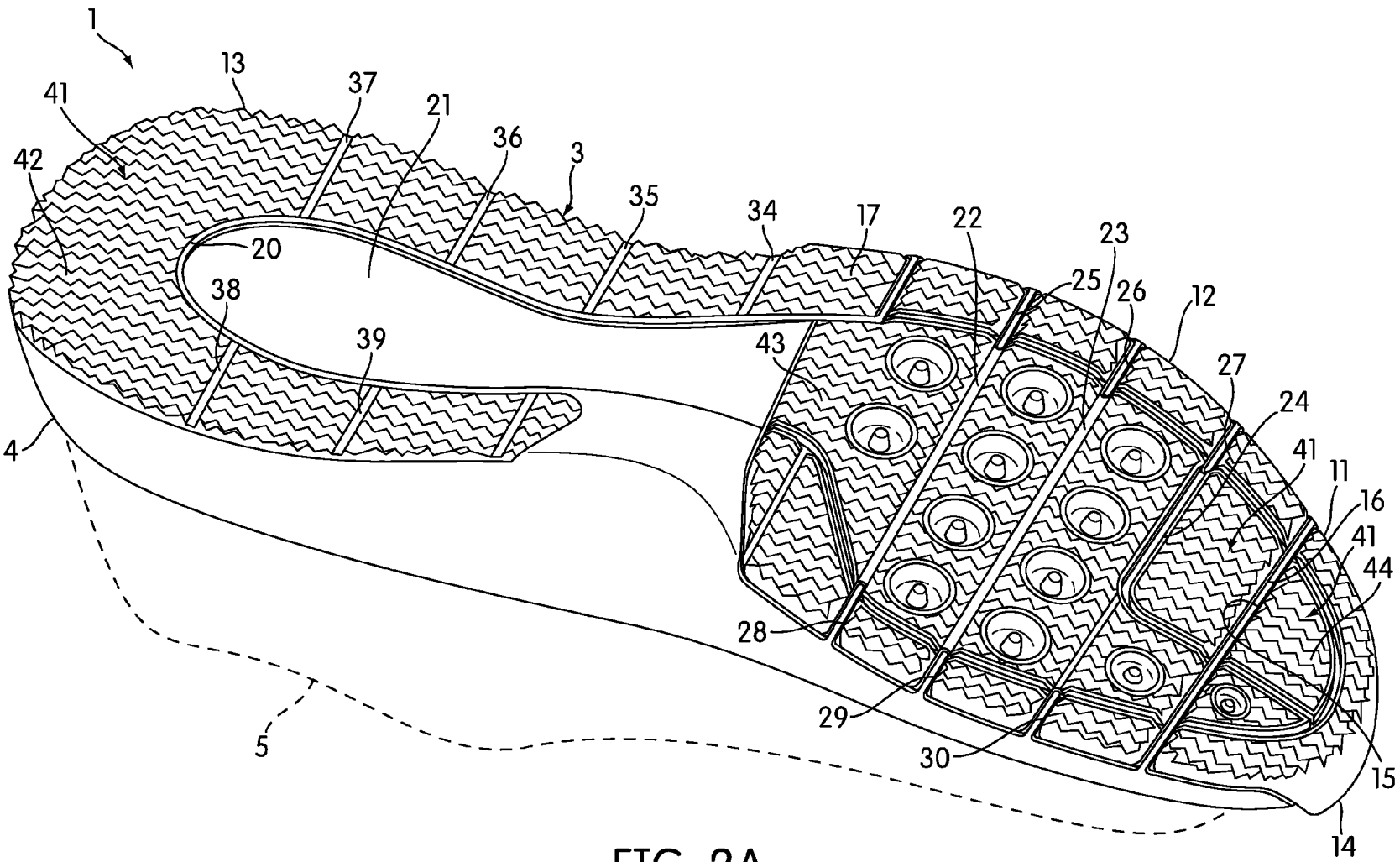
FIG. 2A is a medial bottom perspective view of the shoe of FIG. 1.

FIG. 2A is a medial bottom perspective view of shoe 1 showing details of the exposed bottom side of outsole 3. The locations of certain regions in sole structure 2, and in sole structures according to other embodiments, may be described using references to human foot anatomy. Specifically, various regions of a described sole structure may be identified using foot bones of a person wearing a shoe that includes the described sole structure. A region or component of a sole structure indicated as corresponding to a particular anatomical structure will lie under that anatomical structure (and perhaps under other anatomical structures) when the shoe is worn. Identifications in this manner assume that the shoe is properly sized for the wearing foot.

When referring to an outsole or other component of a sole structure, a "forefoot" region will generally lie under or near the metatarsal and phalangeal bones of a shoe wearer's foot and may extend beyond the wearer's toes to the frontmost portion of the shoe. A forefoot region may extend beyond the medial or lateral peripheral edge of the wearer's foot. A "midfoot" region will generally lie under or near the cuboid, navicular, medial cuneiform, intermediate cuneiform and lateral cuneiform bones of the wearer's foot. A midfoot region may also extend beyond the medial or lateral peripheral edge of the wearer's foot. A "hindfoot" region of a sole structure extends from the midfoot region and under/near the wearer calcaneus (heel bone), may extend to the rearmost portion of the shoe, and may also extend beyond the medial or lateral peripheral edge of the wearer's foot. One or more of the above-described regions may overlap, and description of a component by reference to a particular anatomical structure does not require that the component cover that entire anatomical structure. For example, and as discussed in further detail below, outsole 3 does not completely cover the bottom side of midsole 4, and thus would not contain portions lying under all portions of all of a wearer's foot bones.

In the embodiment of shoe 1, outsole 3 comprises a front outsole element 11, a middle outsole element 12, and a rear outsole element 13. In other embodiments, an outsole may be a single element or may consist of two, four or other numbers of separate elements. Outsole 3 could be molded as a single unit. Elements 11, 12 and 13 could then separated and bonded to midsole 4 (e.g., with adhesive) during assembly of shoe 1. Front element 11 is located in a forefoot region of sole structure 2 and covers the frontmost portion of the bottom of midsole 4. In the embodiment of shoe 1, front element also includes a toe cap 14 that wraps around the frontmost portion of midsole 4 and of upper 5. Rear edge 15 of outsole element 11 may be approximately located on a line that passes under the first and second distal phalanges.

Middle element 12 is also located in the forefoot region of sole structure 2. Element 12 covers the bottom portion of midsole 4 corresponding to the distal ends of the first through fifth metatarsals, to the first through fifth proximal phalanges, to the second through fifth intermediate phalanges, and to the third through fifth distal phalanges. Front edge 16 of element 12 may approximately correspond to front portions of the first and second distal phalanges.

Rear element 13 includes portions in the forefoot, midfoot and hindfoot regions of sole structure 2. A front portion 17 of element 13 generally corresponds to the fifth metatarsal. Element 13 then continues around the outer edges of midsole in the mid- and hindfoot regions. Portions of element 13 correspond approximately to locations of a wearer's cuboid, calcaneus, navicular, medial cuneiform and intermediate cuneiform bones.

In the embodiment of shoe 1, the interior region 20 of rear element 13 is open and exposes a bottom side 21 of midsole 4. The exposed portion of midsole 4 bottom side 21 within opening 20 is recessed relative to element 13. In other embodiments, rear element 13 may have a different configuration of open region(s) or may lack an open region altogether.

Each of elements 11, 12 and 13 has a shape that generally corresponds to the outer edges of a corresponding portion of sole structure 2. For example, the medial and lateral edges of forward element 11 are generally aligned with side edges of midsole 4 in the region where element 11 is attached. As previously indicated, toe cap 14 wraps around the frontmost portion of midsole 4. Lateral edges of middle element 12 are generally aligned with lateral edges of midsole 4 in the region where middle element 12 is attached. Medial edges of element 12 are generally aligned with medial edges of midsole 4 in the same region. The outer edge of rear element 13 is generally aligned with the outer edge of midsole 4 in the region where rear element 13 is attached, although a small rearmost heel portion 47 (see FIG. 3) of rear element 13 wraps slightly upward over the rearmost side of midsole 4.

In some embodiments, an outsole may include one or more flexure zones to increase flexibility of a sole structure. In the embodiment of shoe 1, middle element 12 of outsole 3 includes grooves 22, 23 and 24. Lateral side slots 25, 26 and 27 formed in the lateral edge of element 12 act as lateral side extensions of grooves 22, 23 and 24. Medial side slots 28, 29 and 30 formed in the medial edge of element 12 similarly act as medial side extensions of grooves 22, 23 and 24. Another flexure zone is created by the space between rear edge 15 of front element 11 and front edge 16 of middle element 12. Rear element 13 may also include flex grooves 34-39.

A tread pattern 41 is formed on the exposed bottom side 42 of rear outsole element 13, on the exposed bottom side 43 of middle element 12, and on the exposed bottom side 44 of front element 11. For convenience, tread pattern 42 is shown as a simple herringbone pattern. Other tread patterns (or combinations of tread patterns) could alternatively be used. For example, a tread pattern could comprise chevron shapes of alternating orientations and that create a discontinuous herringbone pattern.

Figure 2B:
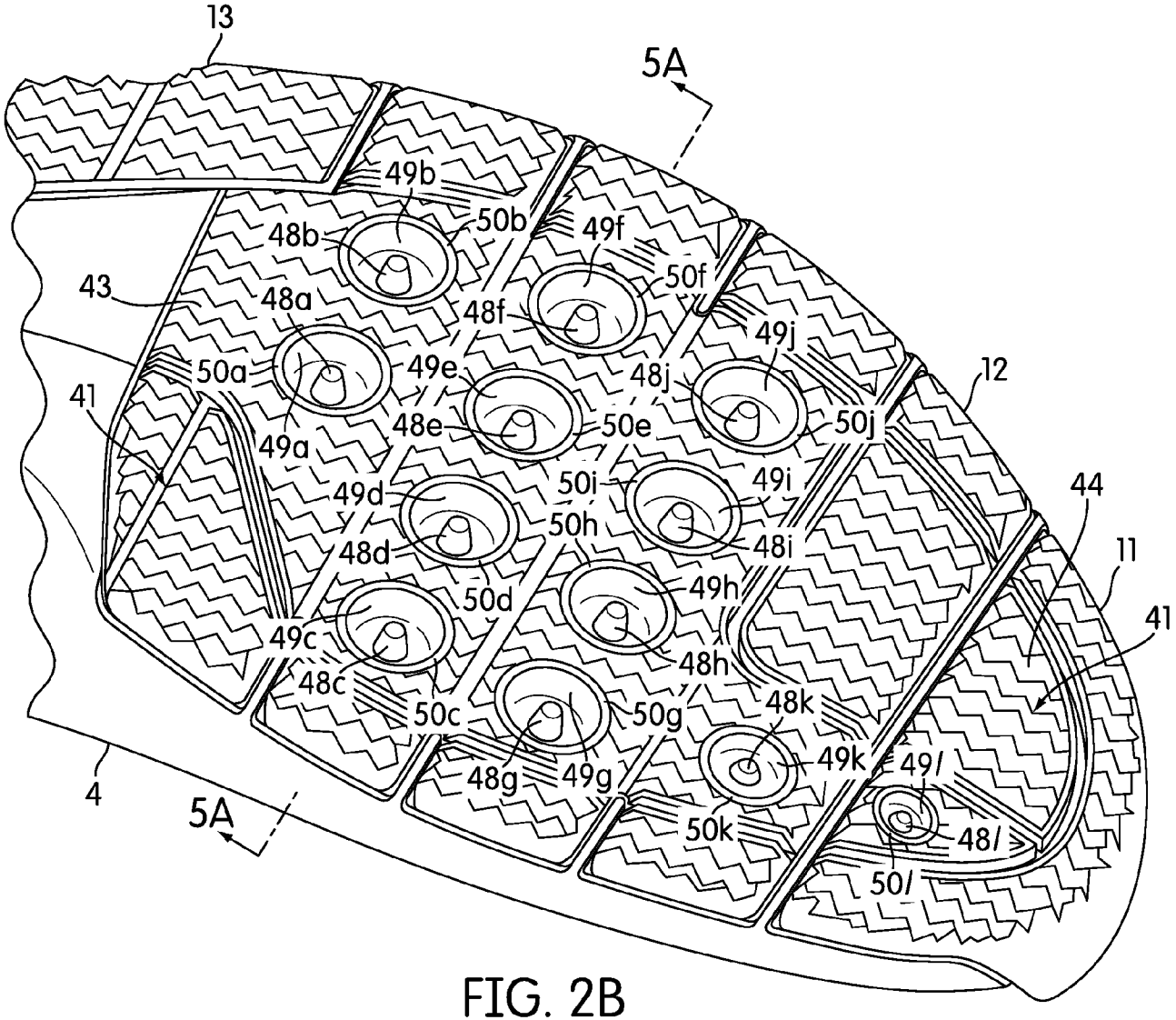
FIG. 2B is an enlarged medial bottom perspective view showing a forefoot portion of the sole structure of the shoe from FIG. 1.

FIG. 2B is an enlarged medial bottom perspective view showing a forefoot portion of sole structure 2. Outsole 3 further includes a plurality of extendable traction elements 48*a*, through 48*l*. Each of traction elements 48*a*, through 48*l*, is located within a corresponding one of recesses 49*a*-49*l*. Recesses 49*a*, through 49*k*, and traction elements 48*a*, through 48*k*, are formed in the bottom side 43 of middle outsole element 12. Recess 49*l*, and traction element 48*l*, are formed in the bottom side 44 of front outsole element 11. As explained in more detail below, midsole 4 and outsole elements 11 and 12 are configured so that one or more of traction elements 48*a*, through 48*l*, are extended in response to a force induced by a person wearing shoe 1.

In the embodiment of shoe 1, each of recesses 49*a*, through 49*l*, has a concave shape of a dome interior. Each of recesses 49*a*, through 49*l*, has a rim (50*a*, through 50*l*) that is at roughly the same level as the peaks of the surrounding regions of tread pattern 41. In other embodiments, some or all of the rims 50*a*, through 50*l*, may be absent or may have a different height. Similarly, outsoles according to some embodiments may have extendable traction elements located within recesses having different shapes.

Figure 3:
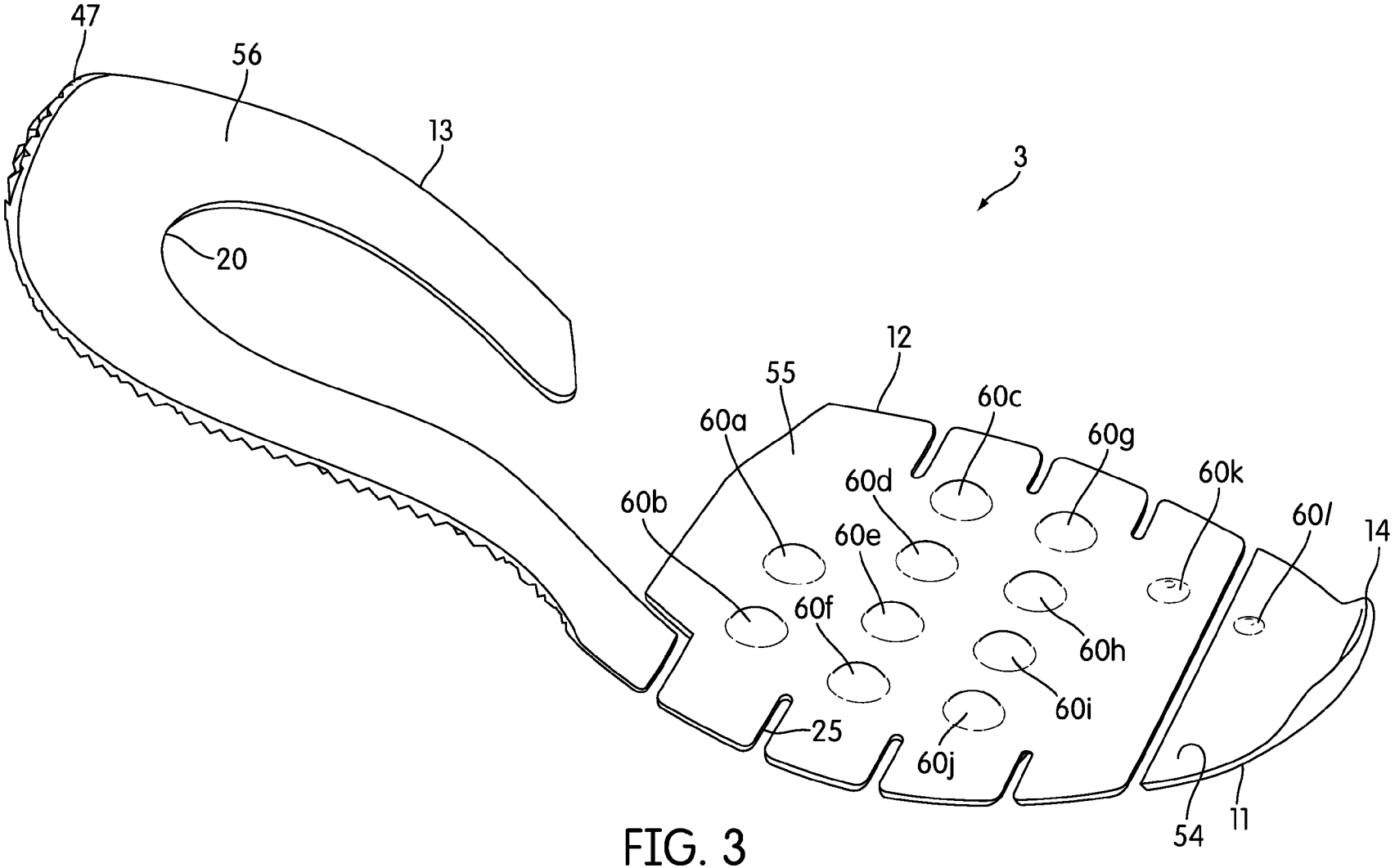
FIG. 3 is a lateral top perspective view of the outsole of the shoe of FIG. 1.

FIG. 3 is a lateral perspective view of the top sides 54, 55 and 56 of outsole elements 11, 12 and 13, respectively. As can be appreciated by comparing FIGS. 3 and 2A, top side 56 of rear outsole element 13 is opposite bottom side 42. Similarly, top side 55 of middle outsole element 12 is opposite bottom side 43 and top side 54 of front outsole element 11 is opposite bottom side 44.

Figure 4:
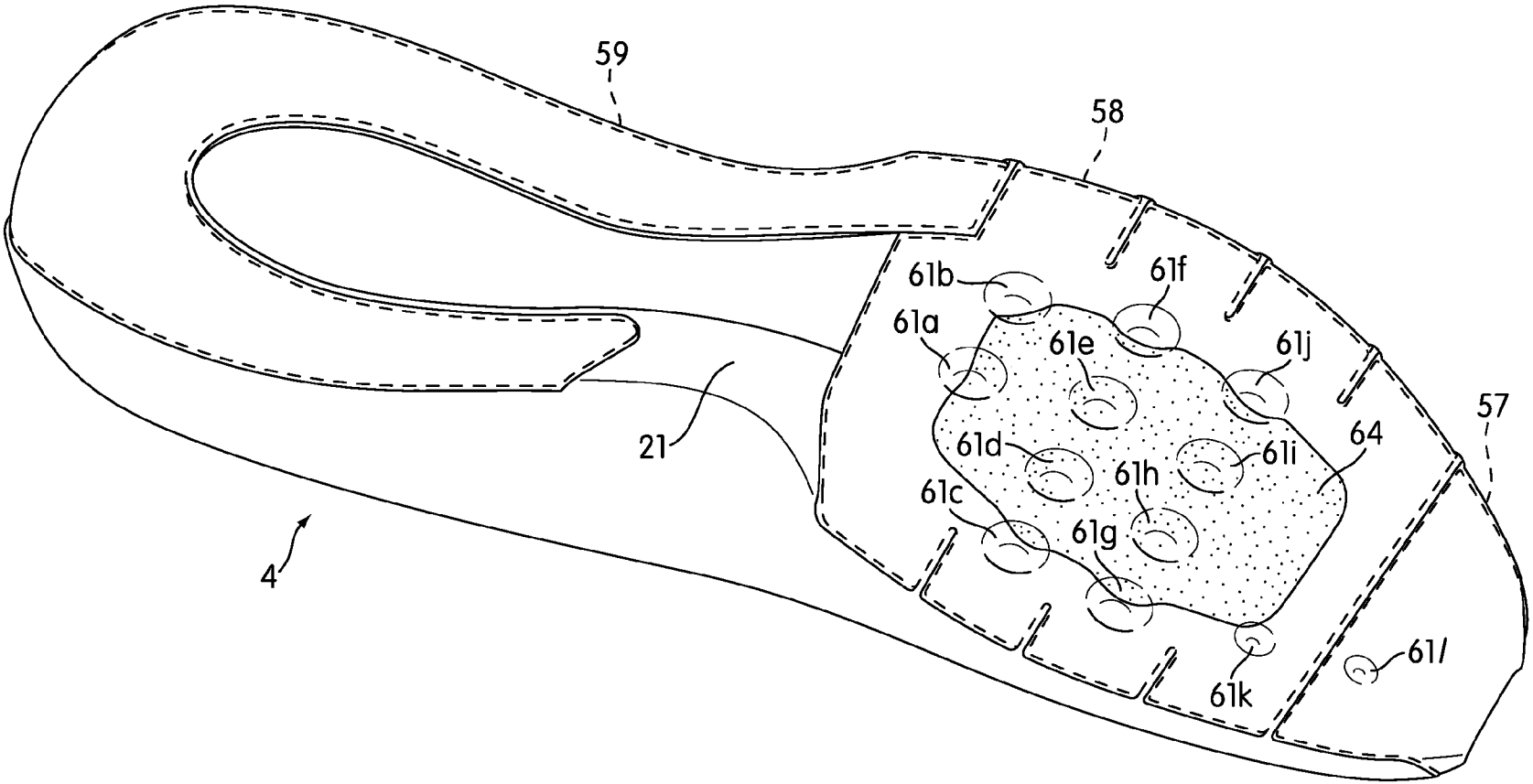
FIG. 4 is a medial bottom perspective view of the midsole of the shoe of FIG. 1.

Once shoe 1 is assembled, top sides 54, 55 and 56 would not be exposed, as each would be bonded to a portion of the bottom side 21 of midsole 4. FIG. 4 is a medial top perspective view of midsole 4 without outsole elements 11, 12 and 13. During assembly of shoe 1, top side 56 of rear outsole element 13, top side 55 of middle outsole element 12 and top side 54 of front outsole element 11 are respectively bonded to regions 59, 58 and 57 of midsole bottom side 21.

The rear side of toe cap 14 would be bonded to the frontmost regions of midsole 4 and upper 5. The front side of heel portion 47 would be bonded to the rearmost side of midsole 4.

As seen in FIG. 3, raised regions 60*a*, through 60*k*, are formed in top side 55 of middle outsole element 12. A raised region 60*l*, is similarly formed in top side 54 of front outsole element 11. Raised region 60*a*, corresponds to and is aligned with recess 49*a*, and traction element 48*a*, (FIG. 2A). Specifically, the concave space of recess 49*a*, lies under raised region 60*a*,, and the center of traction element 48*a*, is approximately aligned with the center of raised region 60*a*. In a similar manner, each of raised regions 60*b*, through 60*l*, corresponds to and is aligned with a respective one of recesses 49*b*, through 49*l*, as well as with a respective one of traction elements 48*b*, through 48*l*.

Returning to FIG. 4, depressions 61*a*, through 61*l*, are formed in bottom side 21 of midsole 4. Each of raised regions 60*a*, through 60*l*, corresponds to a respective one of depressions 61*a*, through 61*l*. As partially shown below in connection with FIG. 5A, the portion of outsole element 12 top side 55 occupied by one of raised regions 60*a*, through 60*k*, is bonded to the portion of the midsole 4 bottom side 21 occupied by the corresponding one of depressions 61*a*, through 61*k*. Similarly, the portion of outsole element 11 top side 54 occupied by raised region 60*l*, is bonded to the portion of midsole 4 bottom side 21 occupied by depression 61*l*.

In the embodiment of shoe 1, midsole 4 is formed by injection molding two types of compressed ethylene vinyl acetate (EVA) foam (also known as Phylon). In particular, most of midsole 4 is formed from a first type of EVA foam, but an insert 64 is formed from a second type of EVA foam. The material used for insert 64 can be less dense than the material of the remainder of midsole 4 so as to be slightly softer and increase wearer comfort. In some embodiments, foam material for an insert similar to insert 64 could be denser (and firmer) than foam material used for other portions of a midsole. In still other embodiments, an entire midsole may be formed from a single type of foam having a generally uniform density.

The location of insert 64 approximately corresponds to the center of the forefoot region. In some embodiments, that location roughly corresponds to the location of the second and third proximal phalanges and to the second and third proximal-phalangeal joints. In other embodiments, an insert similar to insert 64 could be larger and extend over a larger portion of the midsole. In yet other embodiments, a midsole may include more than two types of material.

Figure 5A:
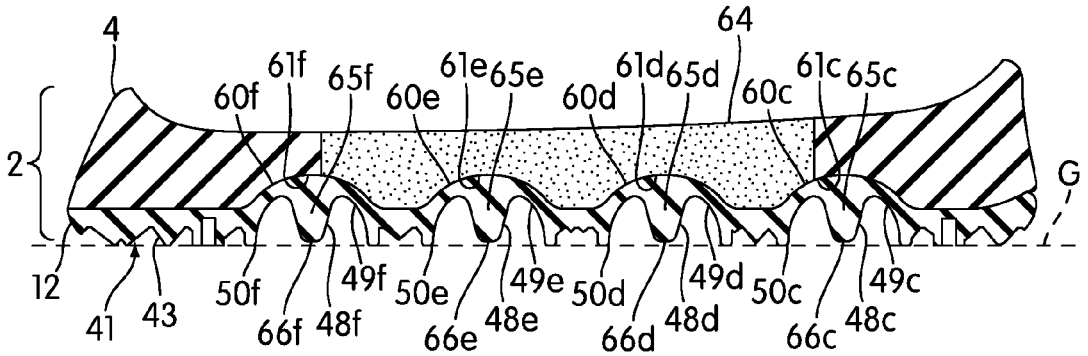
FIG. 5A is an enlarged area cross-sectional view of a portion of the sole structure of the shoe of FIG. 1 in an unloaded condition.

FIG. 5A is an enlarged area cross-sectional view of sole structure 2 from the location indicated in FIG. 2B. The view of FIG. 5A has also been rotated so as to place bottom side 43 of outsole element 12 adjacent to a firm but penetrable ground surface G. FIG. 5A assumes that sole structure 2 is lightly loaded. For example, a wearer of shoe 1 may be standing and placing most of his or her weight on his or her heel. In the unloaded condition of FIG. 5A, the region of midsole 4 within the cross-sectional plane is not significantly compressed and the region of outsole element 12 within that plane is generally undeformed.

FIG. 5A shows additional details of traction elements 48*c*, through 48*f*,, of the corresponding recesses (49*c*, through 49*f*) and raised regions (60*c*, through 60*f*) of outsole element 12, and of the corresponding depressions 61*c*, through 61*f*, of midsole 4. The details of the remaining traction elements, their corresponding outsole element recesses and raised regions, and their corresponding midsole depressions are similar, although sizes of certain other traction elements and their corresponding components may vary.

The concave spaces within each of recesses 49*c*, through 49*f*, is aligned with the corresponding one of raised regions 60*c*, through 60*f*, and contains the corresponding one of traction elements 48*c*, through 48*f*. Each of traction elements 48*c*, through 48*f*, is generally frustoconical in shape. Each has a proximal end (65*c*, through 65*f*) centered in the base of its corresponding recess. For example, traction element 48*f*, has a proximal end 65*f*, centered in the base of recess 49*f*. Each of traction elements 48*c*, through 48*f*, further includes a distal end (66*c*, through 66*f*). In the unloaded condition of FIG. 5A, the distal ends of the traction elements do not extend beyond the rims of their corresponding outsole recesses. For example, distal end 66*e*, of traction element 48*e*, is within recess 49*e*, and does not extend beyond rim 50*e*.

Figure 5B:
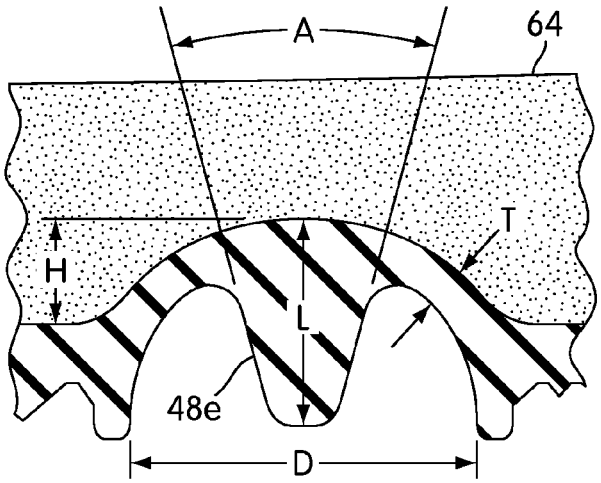
FIG. 5B is a further enlarged portion of the area cross-sectional view of FIG. 5B.

FIG. 5B is a portion of FIG. 5A that has been further enlarged to show dimensions of various outsole portions associated with a traction element and its corresponding recess and raised region. In some embodiments, each of recesses 49*a*, through 49*j*, has a diameter D of approximately 13.6, millimeters (mm) In such embodiments, a recess-to-raised-region wall thickness T in the regions near a traction element proximal end is approximately 1.5, mm. A length L of traction elements 48*a*, through 48*k*, in such embodiments is approximately 7.5, mm, the angle A of such traction elements is approximately 36, degrees, and the height H of the raised region peak above the outsole element top side is approximately 3.9, mm. With regard to recess 49*k*,, traction element 48*k*, and raised region 60*k*,, dimensions D, T, L, A and H are approximately 11.4, mm, 1.7, mm, 4.5, mm, 58° and 0.9, mm, respectively. With regard to recess 49*l*, traction element 48*l*, and raised region 60*l*, dimensions D, T, L, A and H are approximately 7.7, mm, 1.7, mm, 4.6, mm, 34° and 0.8, mm, respectively. The preceding dimensions are only examples. Dimensions of traction elements, corresponding outsole recesses and corresponding outsole raised regions in other embodiments may vary.

In some embodiments, traction elements 48*k*, and/or 48*l*, together with their corresponding structures (recesses 49*k*, and 49*l*, rims 50*k*, and 50*l*, raised regions 60*k*, and 60*l*, midsole depressions 61*k*, and 61*l*) could be omitted or placed in alternate locations. Indeed, one or more of the other traction elements 48*a*-48*j*, and their corresponding structures could be omitted or be placed in an alternate location in some embodiments. Similarly, additional traction elements and corresponding structures could be included.

Figure 5C:
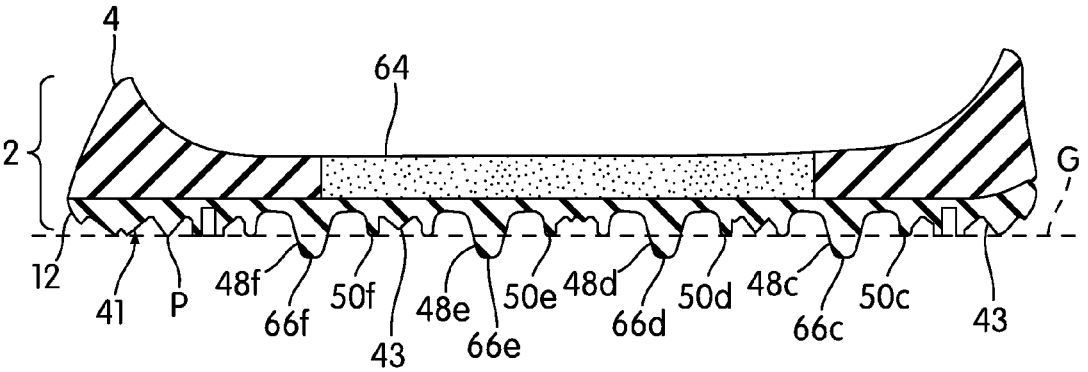
FIG. 5C is an enlarged area cross-sectional view of a portion of the sole structure of the shoe of FIG. 1 in a loaded condition.

FIG. 5C is an enlarged area cross-sectional view of sole structure 2 similar to FIG. 5A. In FIG. 5C, however, sole structure 2 is in a loaded condition. In particular, a wearer of shoe 1 may be running or otherwise placing more body weight on the portion of sole structure 2 containing traction elements 48*c*, through 48*f*. The downward force of the wearer-induced load compresses midsole 4 and tends to deform raised regions 60*c*, through 60*f*. As a result, traction elements 48*c*, through 48*f*, are pushed downward so that distal ends 66*c*, through 66*f*, extend beyond rims 50*c*, through 50*f*, and into ground surface G. As seen in FIG. 5C, distal ends 66*c*, through 66*f*, also extend beyond the peaks of tread pattern 41. For convenience, one of the tread pattern 41 peaks is indicated in FIG. 5C with a reference character "P". By extending distal ends of traction elements beyond the peaks of tread pattern 41, greater traction may be obtained than would be available solely from tread pattern 41.

Although FIG. 5C only shows extension of traction elements 48*c*, through 48*f*, in response to a wearer-induced load, others of traction elements 48*a*, through 48*d*, and 48*g*, through 48*l*, could be extended in a similar manner. Depending on the magnitude and distribution of a wearer-induced load, however, various of traction elements 48*a*, through 48*l*, could be fully extended while others of traction elements 48*a*, through 48*l*, might only be partially extended, or not extended at all.

Figure 6:
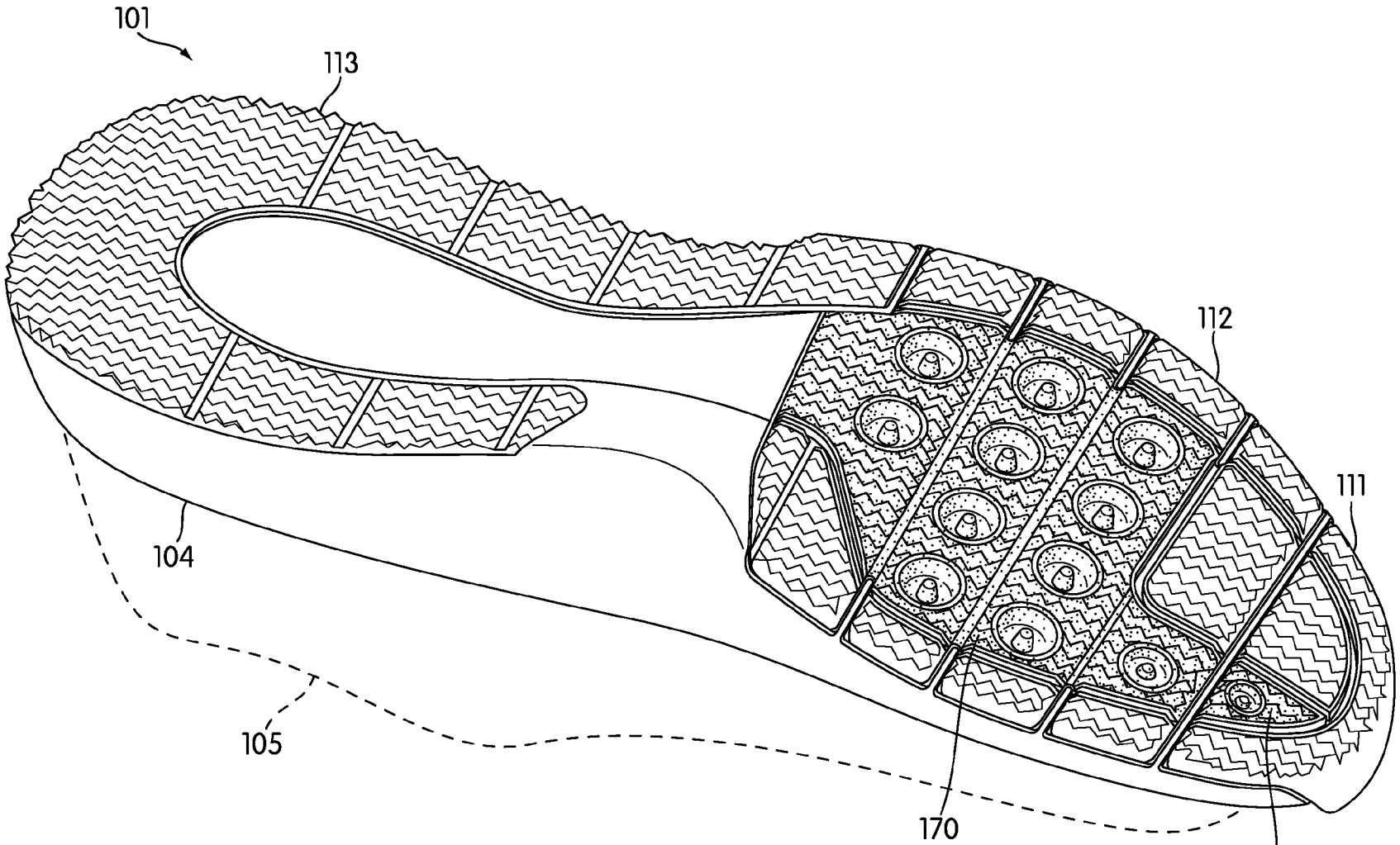
FIG. 6 is a medial bottom perspective view of a shoe according to another embodiment.

Outsole 3 can be formed from rubber or from other types of elastomeric materials. In the embodiment of shoe 1, outsole 3 is formed from a single type of synthetic rubber. In certain embodiments, more than one type of rubber might be used. FIG. 6 is a medial bottom perspective view of a shoe 101 according to one such embodiment. Features in the embodiment of FIG. 6 may be structurally similar to features in FIGS. 1-5C having similar reference numbers. In particular, and except as otherwise described below, upper 105, midsole 104, rear outsole element 113, middle outsole element 112 and front outsole element 111 of shoe 101 may be structurally similar to upper 5, midsole 4, rear outsole element 13, middle outsole element 12 and front outsole element 11 of shoe 1. Unlike middle outsole element 12, however, an interior portion 170 of middle outsole element 112 is formed from a first type of rubber that is harder than a second type of rubber used to form the other portions of middle outsole element 112. Similarly, an interior portion 171 of front outsole element 111 is formed from the harder first type of rubber and the remainder of front element 111 is formed from the softer second type of rubber. Outsole elements 111, 112 and 113 could be molded as a single piece in a multi-shot molding process. Elements 111, 112 and 113 could then be separated from one another and bonded to midsole 104. In some embodiments, the first type of rubber could have a Shore A durometer of approximately 70-76, and the second type of rubber could have a Shore A durometer of approximately 64-70.

Portions 170 and 171 are indicated in FIG. 6 with a light stippling pattern. However, the first type of rubber in portions 170 and 171 could have an appearance that is the same that of the second type of rubber used to form other outsole portions. Alternatively, portions 170 and/or 171 could have a color, texture or other appearance characteristic that is different from the color, texture or other appearance characteristic of rubber used in other portions of the outsole.

In the embodiments described thus far, the extendable traction elements were integrally molded as part of the outsole elements, with the corresponding outsole recesses and raised regions also formed at the time of molding. This need not be the case, however. In some embodiments, for example, outsole recesses and raised regions could be formed when the outsole is molded. The extendable traction elements could then be separately formed and attached to the outsole within the recesses. Such attachment could be permanent (e.g., by adhesive bonding) or by way of a mechanical fastener (e.g., a threaded connection).

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. A sole structure comprising:

a midsole, wherein the midsole includes a first side and a second side, and the midsole further includes a plurality of depressions formed in the second side; and an outsole element, including a first side directly contacting and coupled to the midsole and a second side opposite the first side of the outsole element that is completely exposed to an exterior of the sole structure, the outsole element further includes a plurality of recesses formed in the second side of the outsole element and a plurality of raised regions formed on the first side of the outsole element, each recess of the plurality of recesses being concave and aligned with a corresponding raised region of the plurality of raised regions of the first side of the outsole element, each of the raised regions is aligned with and is directly coupled to a corresponding depression of the plurality of depressions formed in the second side of the midsole, and each recess of the plurality of recesses includes a corresponding projection extending outward from an interior of the concave region.

2. The sole structure of claim 1, wherein the sole structure is part of an article of footwear, and each raised region of the plurality is configured to deform, in response to a load imposed by a wearer of the article of footwear when the article is worn, so as to extend the projection of the corresponding recess.

3. The sole structure of claim 2, wherein each of the recesses includes a rim, each of the projections includes a proximal end attached to the outsole element within the corresponding recess and a distal end located distally from the proximal end, each of the distal ends is configured to rest within, and is configured to not extend beyond the rim of, the corresponding recess when the sole structure is unloaded, and each of the projection distal ends is configured to extend beyond the rim of the corresponding recess when the corresponding raised region is deformed.

4. The sole structure of claim 1, wherein the outsole element is a substantially solid elastomeric element.

5. The sole structure of claim 1, wherein each of the raised portions is a convex dome-shaped structure and each of the corresponding recesses is a concave dome-shaped region.

6. The sole structure of claim 1, wherein each of the projections is integrally formed with the outsole element.

7. The sole structure of claim 1, wherein the outsole element is formed from one or more rubber materials.

8. The sole structure of claim 7, wherein the outsole element includes a first region formed from a first type of rubber and a second region formed from a second type of rubber.

9. The sole structure of claim 8, wherein the first region comprises the recesses, the associated projections and the corresponding raised portions, and wherein the first type of rubber is harder than the second type of rubber.

10. The sole structure of claim 1, wherein the recesses are located in a forefoot region of the outsole element.

11. An article having a sole structure and comprising:

a midsole element, wherein the midsole element includes a first side and a second side, and the midsole element further includes a plurality of depressions formed in the second side of the midsole element, an outsole element, the outsole element having a shape corresponding to at least a portion of the midsole element, the outsole element further having a first side directly contacting and coupled to the second side of the midsole element and a second side opposite the first side of the outsole element and being completely exposed to an exterior of the sole structure, and wherein the outsole element further includes a plurality of recesses formed in the second side of the outsole element and a plurality of raised regions formed on the first side of the outsole element, each recess of the plurality of recesses being concave and aligned with a corresponding raised region of the plurality of raised regions of the outsole element first side, each of the raised regions is aligned with and is directly coupled to a corresponding depression of the plurality of depressions formed in the second side of the midsole element, and each recess of the plurality of recesses includes a corresponding projection extending outward from an interior of the concave region.

12. The article of claim 11, wherein the outsole element further comprises a tread pattern formed on the second side.

13. The article of claim 11, wherein the article is an article of footwear, and each raised region of the plurality is configured to deform, in response to a load imposed by a wearer of the article of footwear when the article is worn, so as to extend the projection of the corresponding recess.

14. The article of claim 13, wherein each of the recesses includes a rim, each of the projections includes a proximal end attached to the outsole element within the corresponding recess and a distal end located distally from the proximal end, each of the distal ends is configured to rest within, and is configured to not extend beyond the rim of, the corresponding recess when the sole structure is unloaded, and each of the projection distal ends is configured to extend beyond the rim of the corresponding recess when the corresponding raised region is deformed.

15. The article of claim 11, wherein the outsole element is a substantially solid elastomeric element.

16. The article of claim 11, wherein each of the raised portions is a convex dome-shaped structure and each of the corresponding recesses is a concave dome-shaped region.

17. The article of claim 11, wherein each of the projections is integrally formed with the outsole element.

18. The article of claim 11, wherein the outsole element is formed from one or more rubber materials.

19. The article of claim 18, wherein the outsole element includes a first region formed from a first type of rubber and a second region formed from a second type of rubber.

20. The article of claim 19, wherein the first region comprises the recesses, the associated projections and the corresponding raised portions, and wherein the first type of rubber is harder than the second type of rubber.

* * * * *